US008205527B2

(12) United States Patent
Chenelia

(10) Patent No.: US 8,205,527 B2
(45) Date of Patent: Jun. 26, 2012

(54) WATCHBAND BOTTLE OPENER WITH CENTRAL EXTENDING PROJECTION TO RECEIVE A BOTTLECAP THEREUNDER

(76) Inventor: Dominic A. Chenelia, San Diego, CA (US)

( * ) Notice: Subject to any disclaimer, the term of this patent is extended or adjusted under 35 U.S.C. 154(b) by 325 days.

(21) Appl. No.: 12/767,654

(22) Filed: Apr. 26, 2010

(65) Prior Publication Data

US 2011/0259151 A1 Oct. 27, 2011

(51) Int. Cl.
*B67B 7/16* (2006.01)
*B67B 7/44* (2006.01)

(52) U.S. Cl. ..... 81/3.55; 81/3.09

(58) Field of Classification Search ..... 81/3.09, 81/3.55, 3.57, 3.4; 224/152
See application file for complete search history.

(56) References Cited

U.S. PATENT DOCUMENTS

| | | | | |
|---|---|---|---|---|
| 926,807 | A * | 7/1909 | Hough | 81/3.09 |
| 6,761,088 | B1 * | 7/2004 | Sasso | 81/3.57 |
| 7,370,558 | B1 | 5/2008 | Chenelia | |
| 7,617,748 | B1 | 11/2009 | Chenelia | |
| 2007/0163393 | A1 * | 7/2007 | Ondeck et al. | 81/3.57 |

OTHER PUBLICATIONS

U.S. Appl. No. 29/355,174, filed Feb. 3, 2010, Dominic A Chenelia.

* cited by examiner

*Primary Examiner* — David B Thomas
(74) *Attorney, Agent, or Firm* — Gordon & Rees LLP

(57) ABSTRACT

A bottle opening wristband, having: a pivot member; a buckle loop rotatably connected to the pivot member; a first projection extending from a center edge of the buckle loop, the projection being dimensioned to be received under an edge of a bottle cap; and a second projection positioned opposite the first projection, wherein the first and second projections are positioned on opposite sides of the pivot member.

3 Claims, 5 Drawing Sheets

WATCHBAND BOTTLE OPENER WITH CENTRAL EXTENDING PROJECTION TO RECEIVE A BOTTLECAP THEREUNDER

TECHNICAL FIELD

The present invention is a wristwatch buckle designed to open bottle caps.

BACKGROUND OF THE INVENTION

Bottle cap openers are notoriously easy to lose, and are often misplaced in the kitchen. This is especially true of small bottle cap openers.

Sometimes, bottle cap openers are attached to key chains. Such bottle cap openers are typically used as advertising, with various corporate or sports team's logos prominently displayed thereon. These sorts of bottle cap openers often tend to be bulky and gaudy, especially when dangling or rattling on a user's key chain.

It is therefore instead desired to provide a bottle cap opener that is easy to find, and easy to use. It is also desired that such a bottle cap opener be discrete, and can be carried around by a user without drawing attention to the user.

SUMMARY OF THE INVENTION

The present invention provides a bottle opening wristband, comprising: a pivot member; a buckle loop rotatably connected to the pivot member; and a first projection extending from a center edge of the buckle loop, the first projection being dimensioned to be received under an edge of a bottle cap. In addition, a second projection is positioned opposite the first projection, and the first and second projections are positioned on opposite sides of the pivot member. As a result, the buckle loop is dimensioned to receive a bottle cap therein with the first projection reaching under the edge of the bottle cap while the second projection of the buckle loop rests against a top of the bottle cap.

DETAILED DESCRIPTION OF THE DRAWINGS

The present invention is a bottle opening wristband that is small, compact and discrete. It can be carried around by a user without drawing any attention to the user.

Figure 1:
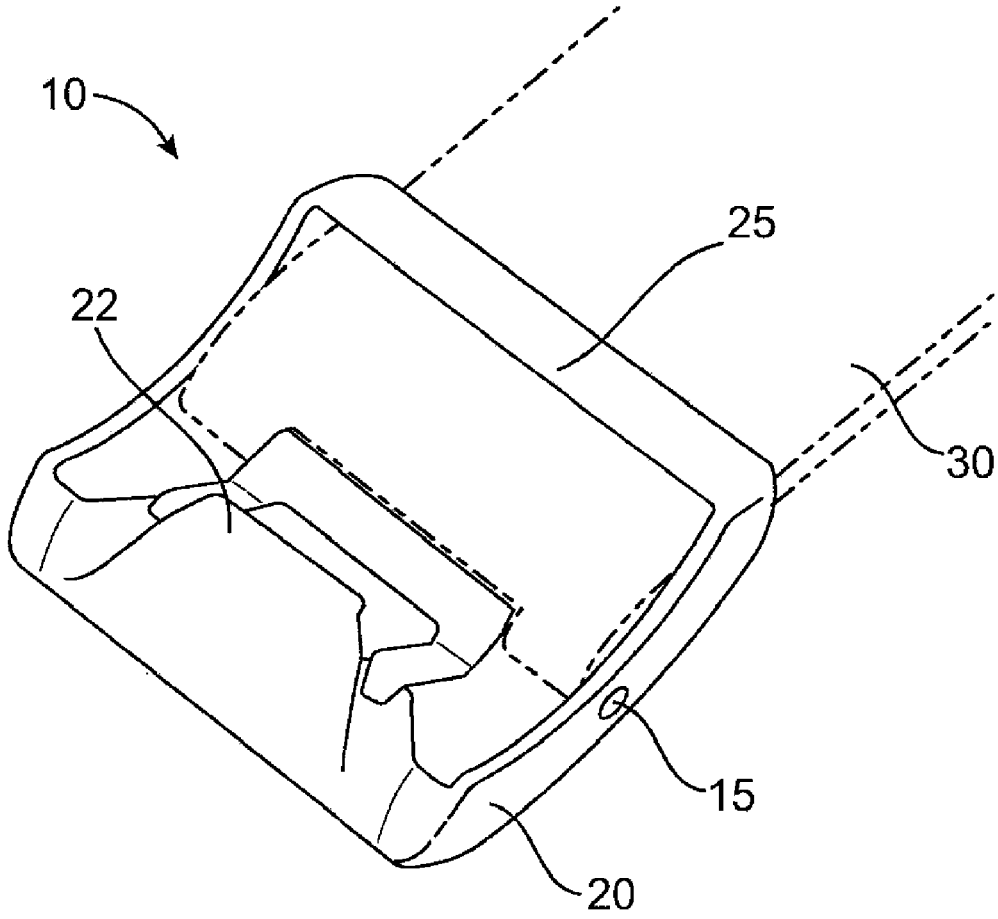
FIG. 1 is a perspective view of the watch band bottle opener positioned on the end of a watch band.
Figure 2:
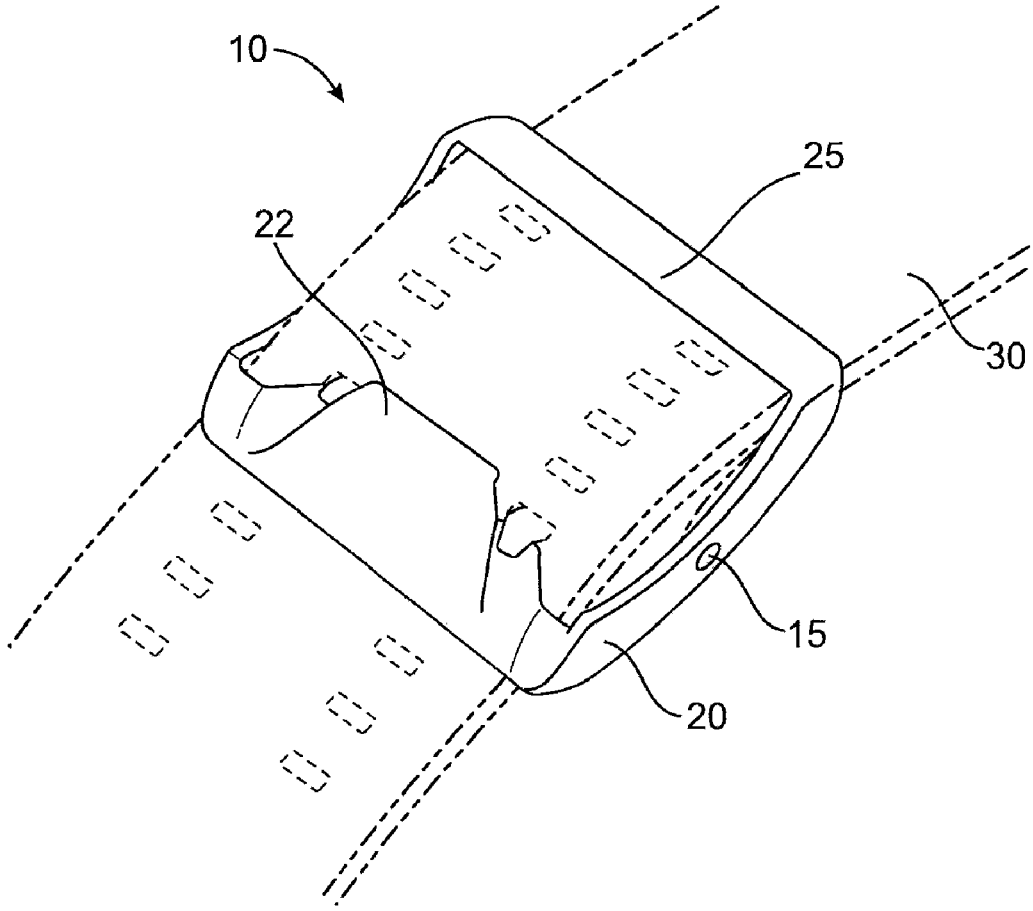
FIG. 2 is a perspective view similar to FIG. 1, but with the watch band bucked.
Figure 3:
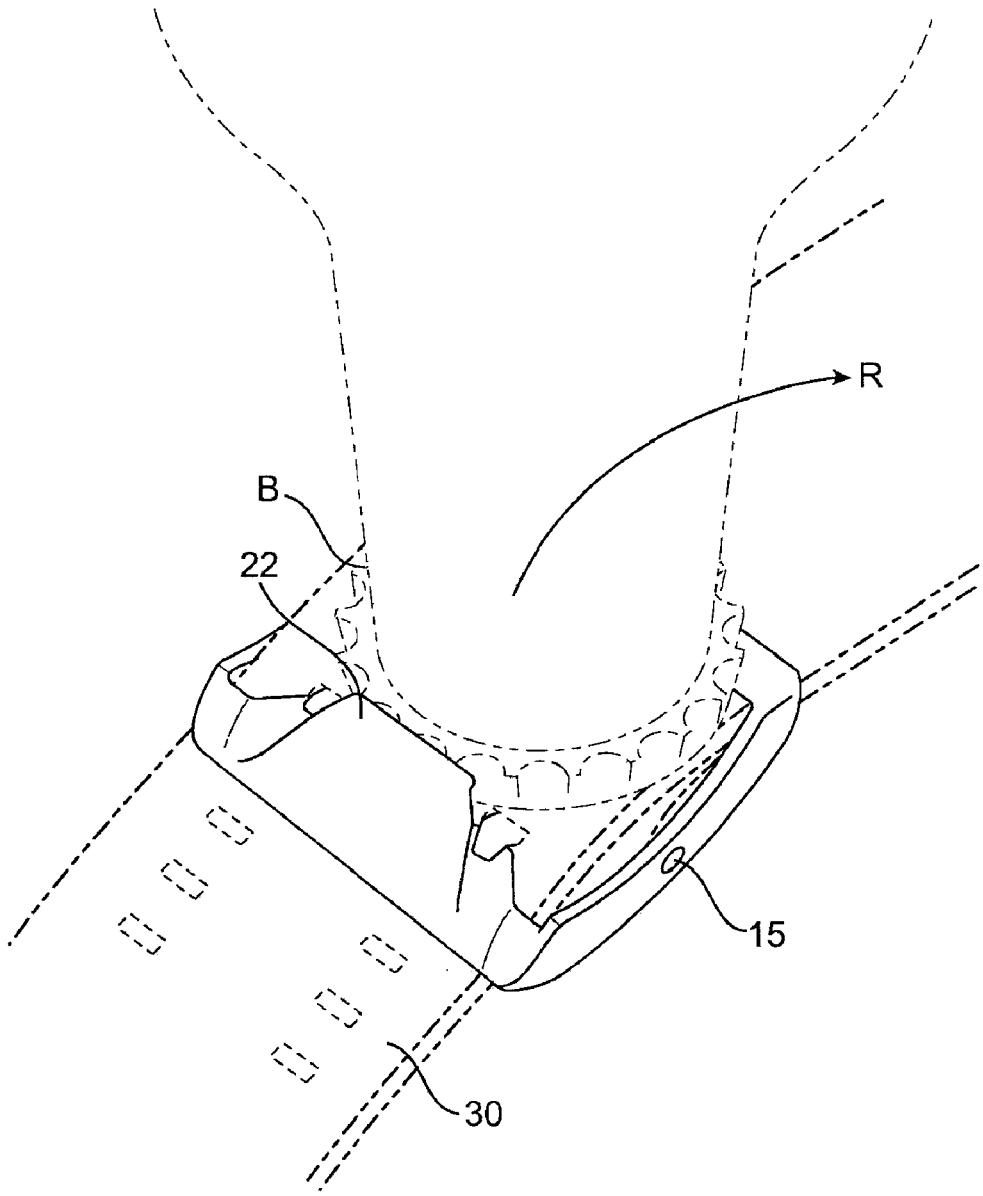
FIG. 3 is a perspective view similar to FIGS. 1 and 2, showing the watch band bottle opener positioned to open the cap of a bottle.
Figure 4:
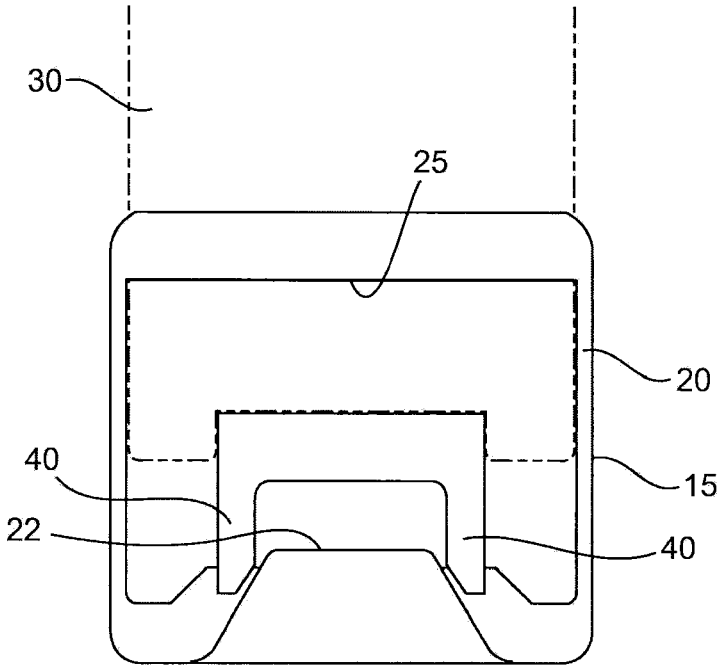
FIG. 4 is a top plan view of the watch band bottle opener.
Figure 5:
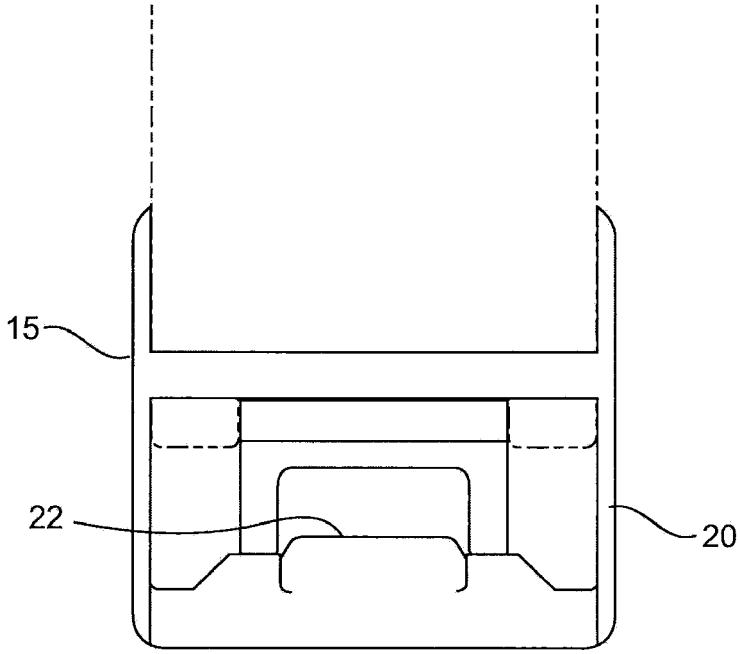
FIG. 5 is a bottom plan view of the watch band bottle opener.

FIGS. 1 to 2 and 4 to 6 illustrate the parts of the present invention. FIG. 3 illustrates the present invention in operation.

The present invention includes a bottle opening wristband 10, comprising: a pivot member 15; and a buckle loop 20 rotatably connected to pivot member 15. A watchband 30 is also included. Pivot member 15 and buckle loop 20 are connected to watchband 30.

Figure 6:
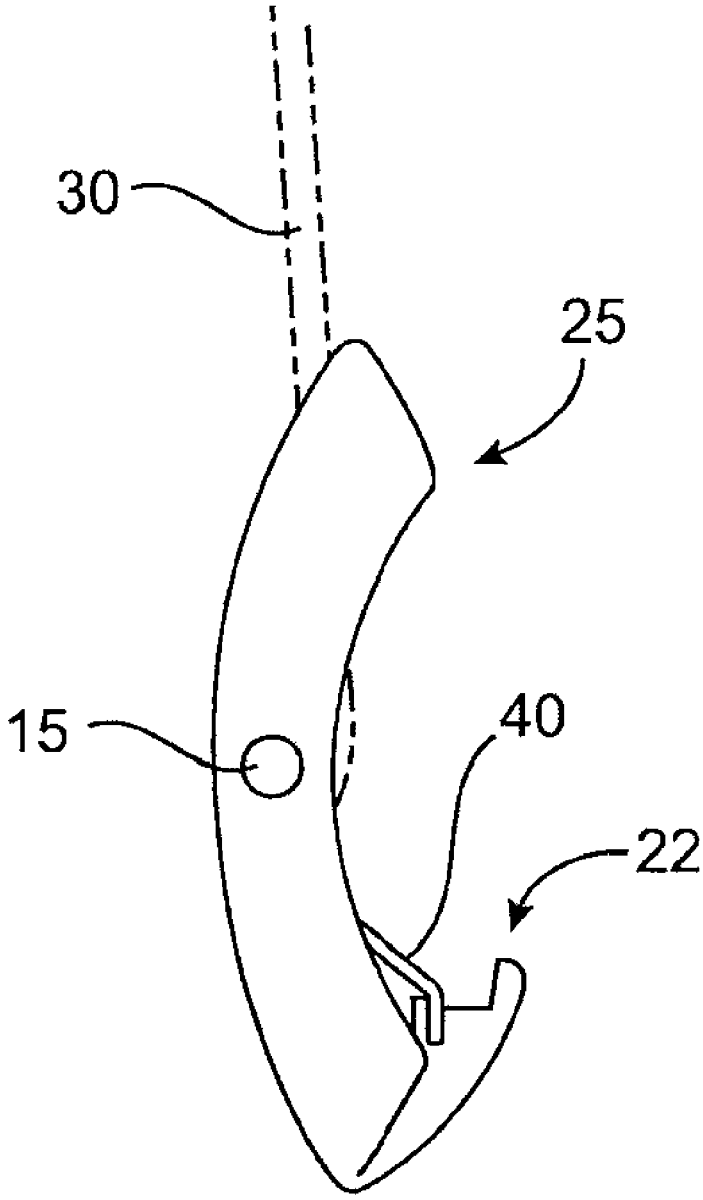
FIG. 6 is a left side elevation view of the watch band bottle opener. (The right side elevation view being a mirror image thereof).

A first projection 22 extends from the center edge of buckle loop 20. As seen in FIGS. 3 and 6, first projection 22 is dimensioned to be received under an edge of a bottle cap B. The second projection 25 is positioned opposite first projection 22, being on an opposite side of central pivot member 15. Thus when bottle cap B is received into buckle loop 20 (as seen in FIG. 3), first projection 22 reaches under the edge of bottle cap B while an opposite second portion 25 of buckle loop 22 rests against the top of the bottle cap. Thus, the user will position the bottle cap as shown in FIG. 3 such that protrusion 22 on buckle loop 20 is received under the edge of bottle cap B while the opposite portion 25 of buckle loop 20 rests under the top of bottle cap B. The user simply rotates the bottle in direction R), and bottle cap B "pops off" of the bottle.

An important advantage of the present invention over the system depicted in Applicant's U.S. Pat. No. 7,617,748 is that bottle cap B contacts buckle loop 20 at two different points (being first projection 22 and second projection 25). This provides stability on opposite sides of the bottle cap. In contrast, in the Applicant's U.S. Pat. No. 7,617,748, the bottle cap pushes down directly on the watch band itself.

In addition, in the present system, the bottle is centered side-to-side with respect to the buckle loop (i.e.: the top of the bottle cap B is centered mid-way along second projection 25). In contrast, in the Applicant's U.S. Pat. No. 7,617,748, the bottle cap rests against a side edge of the device when its cap is removed. As can also be seen, buckle loop 20 and watch band 30 are dimensioned such that bottle cap B is received directly against a center portion of second projection 25 when projection 22 is received under an edge of bottle cap B. This offers the advantage of stability. This is different from the present inventor's system shown in U.S. Pat. No. 7,617,748 in which the bottle cap is positioned against the watch band itself when the bottle cap is removed. This is because the system shown in U.S. Pat. No. 7,617,748 involves a buckle 20 that only extends in one direction away from pivot pin 15. In contrast, in the present system, buckle 20 extends in two opposite directions away from its pivot pin 15. Thus, the opposite end portions of buckle 20 terminate at projection 23 and opposite portions 25 (with pivot pin 15 being disposed midway therebetween). As can also be see in FIG. 3, bottle cap B can span along portion 25. Thus, there is more than one point of contact with bottle cap B. Rather, contact is maintained along a line along portion 25. This further adds to the stability of the present system.

As can also be seen, one or more clasps 40 may also be included. Clasps 40 are rotatably connected to pivot member 15, and clasps 40 can be rotated into a position against buckle loop 20 (as shown).

What is claimed is:

1. A bottle opening wristband, comprising:

a pivot member;

a buckle loop rotatably connected to the pivot member;

a first projection extending from a center edge of the buckle loop, the projection being dimensioned to be received under an edge of a bottle cap; and a second projection positioned opposite the first projection, wherein the first and second projections are positioned on opposite sides of the pivot member.

2. The bottle opening wristband of claim 1, wherein the buckle loop is dimensioned to receive a bottle cap therein with the first projection reaching under the edge of the bottle cap while the second projection of the buckle loop rests against a top of the bottle cap.

3. The bottle opening wristband of claim 1, further comprising:

a watchband, wherein the pivot member and the buckle loop are connected to the watchband.

* * * * *